United States Patent [19]

Hartl

[11] 4,413,356

[45] Nov. 1, 1983

[54] FLAT ROTARY-ANODE X-RAY TUBE

[75] Inventor: Walter Hartl, Hamburg, Fed. Rep. of Germany

[73] Assignee: U.S. Philips Corporation, New York, N.Y.

[21] Appl. No.: 315,700

[22] Filed: Oct. 28, 1981

Related U.S. Application Data

[63] Continuation of Ser. No. 84,971, Oct. 15, 1979, abandoned.

[30] Foreign Application Priority Data

Oct. 16, 1978 [DE] Fed. Rep. of Germany ..... 2845007

[51] Int. Cl.[3] ..... H01J 35/04

[52] U.S. Cl. ..... 378/132; 378/125

[58] Field of Search ..... 378/133, 125, 126, 132, 378/144

[56] References Cited

U.S. PATENT DOCUMENTS

| | | | |
|---|---|---|---|
| 2,549,614 | 4/1951 | Leighton | 378/132 R |
| 3,646,380 | 2/1972 | Hartl | 378/131 X |
| 4,024,424 | 5/1977 | Eggelsmann et al. | 378/132 X |
| 4,081,707 | 3/1978 | Hartl et al. | 378/132 |
| 4,210,371 | 7/1980 | Gerkema et al. | 378/133 |

FOREIGN PATENT DOCUMENTS 2610660 9/1977 Fed. Rep. of Germany .

*Primary Examiner*—David K. Moore
*Assistant Examiner*—Robert E. Wise
*Attorney, Agent, or Firm*—Robert J. Kraus

[57] ABSTRACT

The invention relates to an X-ray tube which comprises a metal housing in which a rotary anode which is mounted on a shaft is journalled to be rotatably by means of two bearings. At least one of the bearings is constructed as a sleeve bearing which comprises dish-shaped, mutually cooperating metal bearing faces which extend transversely of the shaft and which are separated from each other by a layer which serves as a lubricant and which consists of a liquid metal or a liquid metal alloy. The bearing is connected on the one side to the shaft and on the other side to the metal housing. In order to insulate the shaft from the housing, a flat, disc-shaped insulator which is connected to the bearing is provided between the bearing and the housing or between the shaft and the bearing. This concentration is flat and has a low thermal resistance in the direction of the shaft.

5 Claims, 1 Drawing Figure

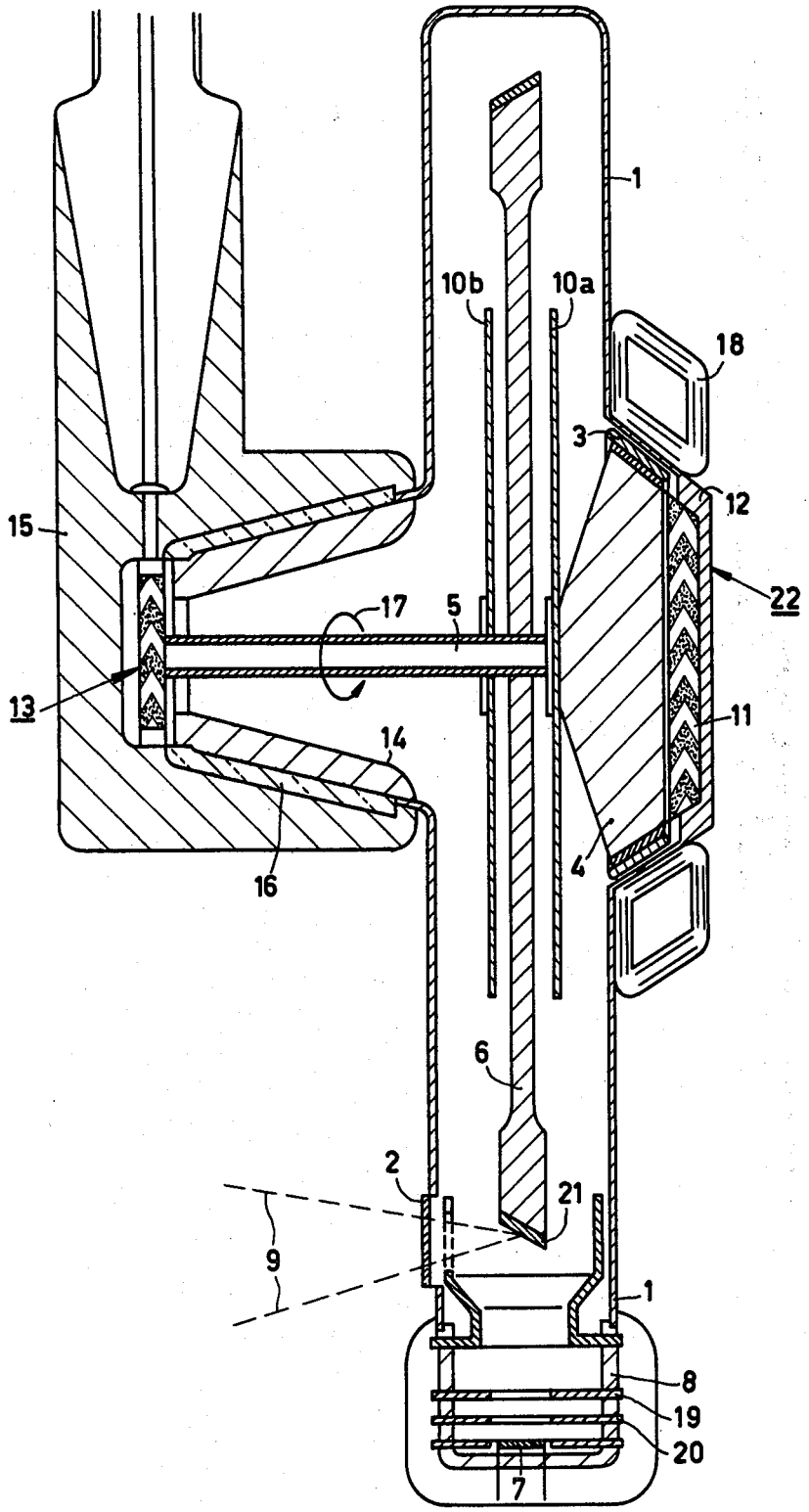
1
10b
10a
18
3
12
15
22
17
5
13
11
14
4
16
6
2
21
9
1
8
19
20
7

FLAT ROTARY-ANODE X-RAY TUBE

This is a continuation, of application Ser. No. 084,971, filed Oct. 15, 1979 now abandoned.

BACKGROUND OF THE INVENTION

The invention relates to an X-ray tube which comprises a metal housing in which a rotary anode which is mounted on a shaft is rotatably journalled by means of two bearings, one bearing being connected on the one side to the metal housing and on the other side, by means of an electrical insulator, to the shaft, while the other bearing is connected on the one side to the shaft and on the other side, by means of an electrical insulator, to the housing.

An X-ray tube of this kind is disclosed in U.S. Pat. No. 4,024,424. Therein, bearings in the form of ball bearings are used. Only a comparatively small heat flow can be dissipated by way of these bearings. Therefore, the electrical power which can be applied to the anode disc, and hence the radiation power to be generated, is limited. Furthermore, the ball bearings must be situated at a comparatively large distance from the anode disc in order to prevent overheating during operation. Consequently, the length of such an X-ray tube in the direction of the drive shaft is comparatively large. Moreover, the loadability of the above X-ray tube is limited because increased loadability would necessitate a substantially increased diameter of the anode disc; this would mean a substantial increase of the moment of inertia and a substantially heavier drive motor would be required.

SUMMARY OF THE INVENTION

The invention has for its object to provide a rotary-anode X-ray tube of the described kind which has a small height in the axial direction and improved dissipation of heat via the bearings. To this end, an X-ray tube in accordance with the invention is characterized in that at least one of the bearings is a sleeve bearing comprising dish-shaped, mutually cooperating metal bearing faces directed transversely of the shaft and separated from each other by a lubricant layer. The lubricant is a liquid metal or a liquid metal alloy. This electrical insulator connected to the bearing is a flat disc directed transversely of the shaft.

In conjunction with the electrical insulator connected thereto, the bearing which itself exhibits a low thermal resistance forms, a flat construction whose thermal resistance is low in the direction of the shaft, so that heat developed in the rotary anode can be suitably dissipated.

In a preferred embodiment of an X-ray tube in accordance with the invention the electrical insulator connected to the metal-lubricated sleeve bearing is a flat cone having a diameter which decreases in the direction of the rotary anode.

The distance between the rotary anode and the insulator may be small, because damaging of the insulator due to discharges possibly occurring due to this short distance is counteracted. Because the diameter of the insulator decreases in the direction of the rotary anode, any electron which reaches the insulator will be exposed to an electrical field which is directed from the insulator to the rotary anode, so that an electron which reaches the insulator (for example, originating from the metal housing) is accelerated towards the anode and will not travel along the insulator surface. Therefore, such an electron will not release other electrons which themselves would release other electrons, so that no electron avalanche will be produced in the direction of the insulator surface. Failures, such as gas eruptions and breakdown of the insulator, are thus avoided.

It is to be noted that sleeve bearings of the kind used in accordance with the invention are already described in U.S. Pat. No. 4,210,371. Sleeve bearings of this kind have a much longer service life than ball bearings. Therefore, unlike X-ray tubes having ball bearings, it is not necessary to accelerate the anode disc to the nominal speed prior to the start of the exposure, after which it has to be brought to a standstill again in order to avoid bearing wear which influences the service life of the rotary-anode X-ray tube. At the beginning of a complete X-ray examination, the drive for the anode disc can be switched on and it can be switched off after termination of this examination, so that the anode disc has already reached the nominal speed during the X-ray exposures performed during the examination and need not be accelerated from standstill. Thus, the anode disc need not be accelerated to the nominal speed in a short period of time, so that a drive power suffices which is substantially smaller than for customary rotary-anode X-ray tubes.

BRIEF DESCRIPTION OF THE DRAWING

An embodiment in accordance with the invention will now be described with reference to the single drawing FIGURE which shows the embodiment in cross-section;

DESCRIPTION OF THE PREFERRED EMBODIMENT

The drawing shows an X-ray tube which comprises a rotary anode 6 and a metal housing 1. The housing 1 has a rotation-symmetrical construction, except for its part which is situated in the vicinity of a radiation exit window 2. A rotor 3 which is arranged inside the metal housing 1 can be driven in known manner by a stator 18 which is arranged outside the metal housing 1. The rotor 3 is rigidly connected to an insulator 4, which itself is connected to a preferably hollow shaft 5 which supports the anode 6 having a diameter of approximately 300 mm.

A cathode 7 is provided on an insulator 8 on the outer circumference of the metal housing 1 in the plane of the anode disc 6. Control electrodes 19 and 20 which are arranged between the cathode 7 and the anode 6 do not form the subject of the present invention. They are described in German Patent Application P No. 28 07 735. Therefore, they will not be elaborated herein. The radiation emitted by a focal path 21 provided on the outer circumference of the anode disc 6 emerges via the window 2 at the side of the housing 1 which is remote from the insulator 4, as denoted by the broken lines 9. However, the radiation can alternatively emerge at the side of the housing 1 which faces the insulator 4 if the anode disc 6 is rotated through 180° with respect to the plane of the drawing around an axis extending perpendicularly to its axis of rotation.

The insulator 4 is arranged in the immediate vicinity of the anode disc and is directly connected to a circular disc **10*a* which is arranged at a small distance from the anode disc 6 and which prevents heating of the insulator by radiation from the central area of the anode disc. A corresponding disc 10*b* is arranged at the opposite side of the anode disc 6**.

The insulator 4, preferably being made of aluminium oxide ceramic, is comparatively flat, so that its thermal resistance in the direction of the shaft 5 is low. The insulator is tapered in the direction of the anode 6 or the disc 10*a*, so that discharge phenomena which could damage the insulator surface are counteracted. The shaft 5 is journalled in the metal housing by means of a sleeve bearing 22 which is connected to the insulator 4. This sleeve bearing 22 is comprised of a first dish-shaped bearing face 11 which is connected to the insulator 4 and which widens in the direction of the anode disc 6. The metal housing comprises a similarly shaped bearing face 12, a narrow gap being maintained between the two bearing faces 11 and 12. One of the bearing faces, the bearing face 11 in the embodiment, is provided with a spiral groove pattern consisting of two groups of spiral grooves which extend at an angle with respect to the axis of rotation and which form a herring bone pattern. Between the two bearings faces 11 and 12, preferably made of W or Mo, there is provided a layer of metal which is liquid at room temperature or a liquid metal alloy, preferably a eutectic alloy of gallium on the one hand and indium and/or tin on the other hand. These alloys are characterized by a low melting point, a low vapour pressure and a high surface stress, so that even in the case of standstill the metal alloy cannot escape from the bearing and the two bearing faces are separated in the operating condition. The spiral grooves force the metal or the metal alloy into the bearing, so that the latter has an extra high dynamic stability. A sleeve bearing of this kind not only has a long service life, but also a low thermal resistance and a low electrical resistance.

The rotor can in principle also be used as a bearing supporting face. This rotor is then preferably provided with a groove pattern. Because copper is not a suitable material for the bearing faces, but is very well suitable for the rotor jacket, the copper jacket of the rotor is then preferably covered with a thin layer of a suitable metal which is not attacked by the metal alloy used as the lubricant, for example, tungsten or molybdenum. In this metal coating there are provided the grooves of the sleeve bearing or the grooves are provided on the bearing face provided on the metal housing.

On the other side of the anode 6 there is provided a sleeve bearing 13 with a liquid metal lubricant. One bearing half is mounted on the hollow shaft 5 and the other bearing half is mounted on an insulator 14 which is connected to the metal housing 1 in a vacuumtight manner. Via the hollow shaft 5, the bearing 13 and a high voltage connector 15, high voltage is applied to the anode disc 6. The high voltage connector 15 is slid onto the insulator 14 via an intermediate rubber seal 16.

What is claimed is:

1. An X-ray tube comprising a housing containing a rotary-anode attached to a shaft for rotation therewith around a longitudinal axis of the shaft, electromotive means for effecting rotation of the shaft, and a plurality of bearings each including first and second parts which are disposed around the axis and rotatable relative to each other, the first part of each bearing being attached to an inner surface of the housing and the second part being attached to the shaft, thereby effecting rotatable mounting of the anode within the housing, the improvement comprising providing at least one of said bearings in the form of a sleeve bearing, the second part of the sleeve bearing being attached to the shaft by means of an intermediate electrical insulator having a tapered end in closer proximity to the anode than the respective bearing, the diameter of said tapered end decreasing with decreasing axial distance from the anode.

2. An X-ray tube as in claim 1 where the tapered end of the insulator is shaped as a relatively flat cone.

3. An X-ray tube as in claim 1 or 2 where said first and second parts include respective, relatively rotatable surfaces which bear against each other and are separated by a layer of lubricant situated between the surfaces, said surface of one of the parts having spiral grooves.

4. An X-ray tube as in claim 1 or 2 where said electromotive means includes a stator attached to the housing and a rotor attached to the insulator at a circumferential surface thereof.

5. An X-ray tube as in claim 1 or 2 and further comprising a disc mounted on the shaft between the insulator and the anode, said disc preventing heating of the insulator by radiation from the anode.

* * * * *